US009275614B2

(12) United States Patent
Ingalls

(10) Patent No.: US 9,275,614 B2
(45) Date of Patent: Mar. 1, 2016

(54) MUSICAL INSTRUMENT

(71) Applicant: John Ingalls, Juneau, AK (US)

(72) Inventor: John Ingalls, Juneau, AK (US)

( * ) Notice: Subject to any disclaimer, the term of this patent is extended or adjusted under 35 U.S.C. 154(b) by 0 days.

(21) Appl. No.: 14/455,322

(22) Filed: Aug. 8, 2014

(65) Prior Publication Data

US 2015/0040739 A1 Feb. 12, 2015

Related U.S. Application Data

(60) Provisional application No. 61/863,766, filed on Aug. 8, 2013.

(51) Int. Cl.
*G10D 7/02* (2006.01)
*G10D 9/04* (2006.01)

(52) U.S. Cl.
CPC ..... *G10D 7/026* (2013.01); *G10D 9/043* (2013.01)

(58) Field of Classification Search
CPC ..... G10D 7/026; G10D 9/02; G10D 9/00; G10D 9/043; G10D 7/005; G10D 7/00; G10D 7/04; G10D 17/00; G10D 7/063; G10D 9/026; G10G 5/00; G10K 5/00
USPC ..... 80/380 R, 384, 385 A, 387 R, 395
See application file for complete search history.

(56) References Cited

U.S. PATENT DOCUMENTS

| | | | | |
|---|---|---|---|---|
| 3,062,084 | A | 11/1962 | Ogilvie | |
| 4,957,029 | A * | 9/1990 | Kahonen | G10D 9/043 84/384 |
| 4,998,456 | A | 3/1991 | Kähönen | |
| 6,124,538 | A | 9/2000 | Landell | |
| 7,014,213 | B1 | 3/2006 | Kaiser | |
| 7,394,007 | B2 | 7/2008 | Keefe et al. | |
| 7,589,268 | B2 | 9/2009 | Keefe et al. | |
| 7,772,472 | B2 | 8/2010 | Chamberlain | |
| 8,273,975 | B2 | 9/2012 | Gisler et al. | |
| 8,324,491 | B1 | 12/2012 | Malluck | |
| 2005/0079371 | A1 | 4/2005 | Guo | |
| 2012/0048094 | A1 * | 3/2012 | Gisler | G10D 7/026 84/384 |
| 2012/0263896 | A1 | 10/2012 | Günthner et al. | |

* cited by examiner

*Primary Examiner* — Kimberly Lockett
(74) *Attorney, Agent, or Firm* — Pearne & Gordon LLP

(57) ABSTRACT

A wind instrument includes a body defining a body with a plurality of tone holes. A plurality of keys are attached to the body, each key of the plurality of keys further including a key pad that is configured to selectively seal at least one of the plurality of tone holes to produce notes of different pitch. In one example, the body includes one monolithic piece of a metal extrusion having a "D"-shaped cross-section that provides a substantially flat upper surface and a lower curved surface. In another example, a biasing member includes a pair of magnets associated with each key, each pair of magnets including a first magnet attached the body and second magnet attached to one of the keys. A position of at least one of the first and second magnets is selectively adjustable relative to the other.

20 Claims, 8 Drawing Sheets

MUSICAL INSTRUMENT

CROSS-REFERENCE TO RELATED APPLICATIONS

This application claims the benefit of U.S. Provisional Application No. 61/863,766, filed 8 Aug. 2013, the entire disclosure of which is hereby incorporated herein by reference.

FIELD OF THE INVENTION

The present disclosure relates to musical instruments, and more particularly to woodwind instruments including an extruded body and single-piece keys.

BACKGROUND OF THE INVENTION

Use of various woodwind instruments, such as flutes, is known. Flutes often include keys composed of multiple pieces requiring laborious silver solder operations to construct each key. Flutes also include keys with closure devices such as springs to urge the keys into an open or closed position over their respective finger holes. On the modern flute, a majority of the keys are normally open and only two are normally closed. Using conventional springs, the NC keys present a problem because the tension on the springs diminishes as the key closes. Using four magnets, the instant design can tailor the force so that the tension increases as the key closes. The closure devices typically exhibit decreased closing force as the keys close over their respective finger holes which can result in poor and/or slow seals over the finger holes. Additionally, many woodwind instruments such as flutes and clarinets include keys operated from only one side of the instrument, thereby limiting effective playing of the instrument. Also, some lightweight woodwind instruments include vaulted bridges constructed of silver and brass which sacrifice strength in order to remain low in weight. Furthermore, many woodwind instruments require separate posts to be added to the instrument body in order to mount axles for keys. There is a need for both improvements to woodwind instruments and developments to improve the manufacture of woodwind instruments

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a wind instrument comprises a body, wherein the body comprises one monolithic piece of a metal extrusion having a "D"-shaped cross-section that provides a substantially flat upper surface extending between first and second ends, and a lower curved surface connecting the first and second ends of the flat upper surface. The body defines a body interior space, a body connection hole, and a plurality of tone holes arranged along a longitudinal length of the body and extending through the substantially flat upper surface of the "D"-shaped cross-section to provide fluid communication between the body interior space and an external environment. A plurality of keys are attached to the body, and each key of the plurality of keys further including a key pad that is configured to selectively seal at least one of the plurality of tone holes to produce notes of different pitch.

In accordance with another aspect of the present invention, a wind instrument comprises a body defining a body interior space and a plurality of tone holes to provide fluid communication between the body interior space and an external environment. A plurality of bosses is coupled to the body. A plurality of keys are attached to the body via the bosses, and each key of the plurality of keys further including a key pad that is configured to selectively seal at least one of the plurality of tone holes to produce notes of different pitch. A biasing member comprises a pair of magnets associated with each key, and each pair of magnets includes a first magnet attached the body and second magnet attached to one of the keys. Said pair of magnets urges said one of the keys to a desired position and is configured to increase an opening or closing force on at least one of the plurality of keys as said key is moved, respectively, to an opened or closed position. A position of at least one of the first and second magnets is selectively adjustable relative to the other of the first and second magnets to thereby adjust a magnetic force between the first and second magnets.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
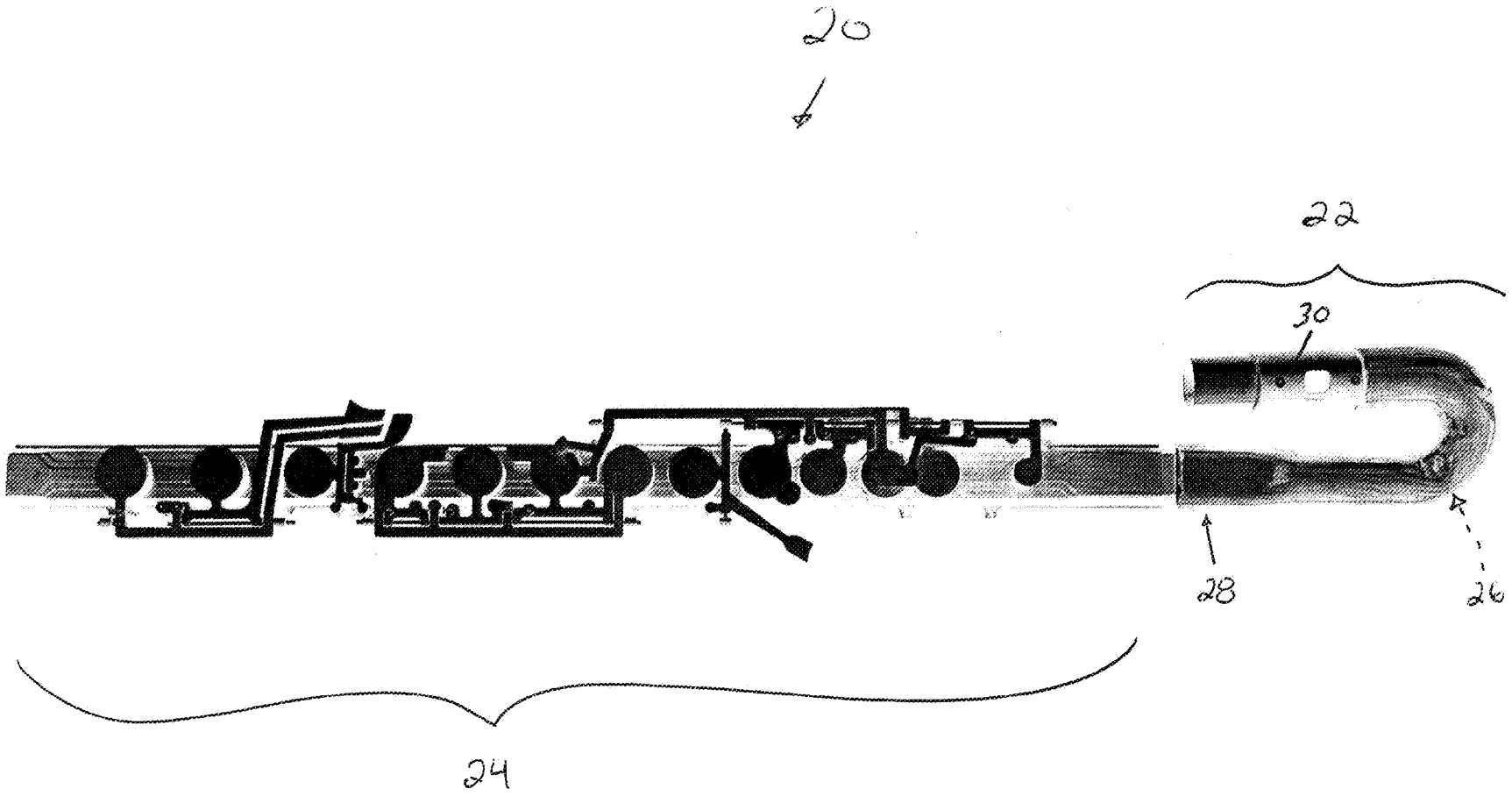
FIG. 1 is a top view of an example musical instrument according to the instant application.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the shown example of FIG. 1, an example wind instrument 20 is shown in accordance with aspects of the present application. It is to be appreciated that the example is for illustrative purposes only and need not present specific limitations upon the scope of the present disclosure. In one example, as shown herein, the wind instrument is a woodwind instrument 20 that is described as being a flute; however, it is understood that the instant application can apply similarly to any type of musical instrument, such as a flute, clarinet, saxophone, oboe, bassoon, etc. and variants thereof. The woodwind instrument 20 can be described as having two sections: the head joint 22 and the body 24. FIG. 1 shows the head joint 22 attached to the body 24, although they can be selectively removed from one another for storage, cleaning, etc. Woodwind instruments 20 may have numerous parts that are attached to one another. The woodwind instrument 20 of this disclosure is not limited to a two-part device.

The head joint 22 defines a head joint interior space 26 (e.g., a hollow interior having a shape generally corresponding to the head joint), a head joint connection hole 28, and a mouth hole 30. The mouth hole 30 enables air to pass between a space exterior to the head joint 22 and the head joint interior space 26. The mouth hole 30 can also be termed an "embouchure." In one example, the head joint 22 can be formed using a three-dimensional (3-D) printing technology, such as plastic printing, stereo lithography, 3D metal printing using a laser sintering process and powdered metals or the like, or other solid-based rapid prototyping method. This provides a distinct advantage in that relatively complex shapes can be produced, such the hollow and curved shape shown in FIG. 1. However, because many of the described methods may not produce a part of sufficient strength or other desired property, the head joint 22 is then encased in a relatively strong protective layer, such as a carbon fiber layer, a fiberglass layer, a secondary polymer layer, a metallic layer, a ceramic layer, or other conforming strong layer. Forming the head joint 22 with a 3D printing technology and providing an additional layer of carbon fiber enables a very strong, yet lightweight head joint 22 that can incorporate complex shapes only attainable by this method. For example, a head joint 22 can be formed to create a smooth transition between the head joint interior space 26, which has a cross section of one shape, and the flute body 24, which has a cross section of a differing shape. In one particular example, the head joint 22 creates a smooth transition between an interior space having a generally circular cross section at the mouth hole 30 to the body 24 of the flute having a "D"-shaped cross section (see FIG. 3). The head joint 22 can include a corresponding "D"-shaped cross section at the head joint connection hole 28 in the end of the head joint 22 where the connection is made with the body 24. In yet another example, only a portion of the head joint may be formed using the printing and encasing method described above. For example, a majority of the head joint may be formed from a relatively strong metallic tube, such as an aluminum tube. However, an adapter can then be used in the vicinity of the head joint connection hole 28 to thereby provide an interface to connect the metallic head joint to the body 24 of the flute. The adapter can be made using the above-described three-dimensional (3-D) printing process which is later encased by a relatively strong protective layer, such as a carbon fiber layer.

Figure 2:
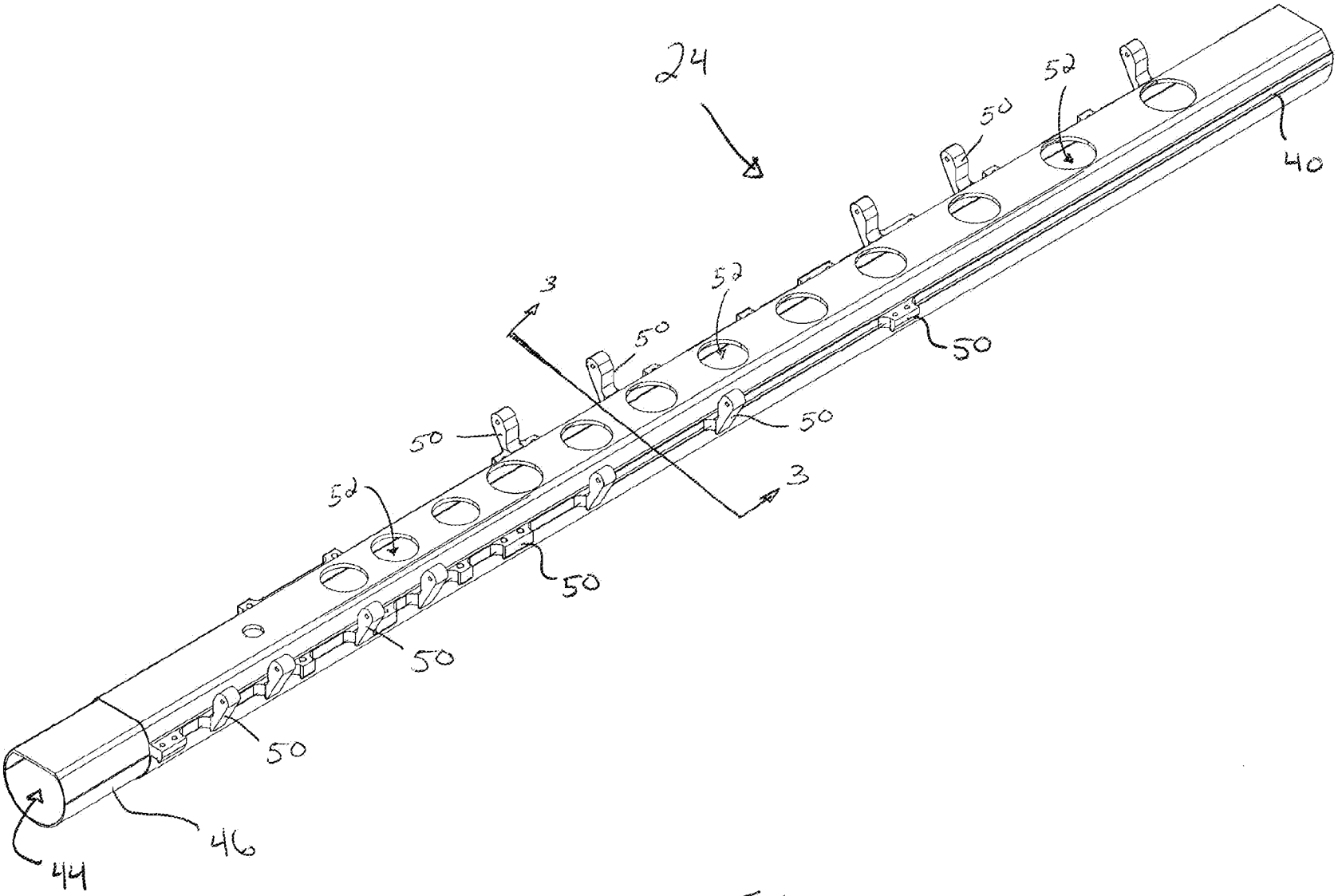
FIG. 2 is a perspective view of an example body of the musical instrument.
Figure 3:
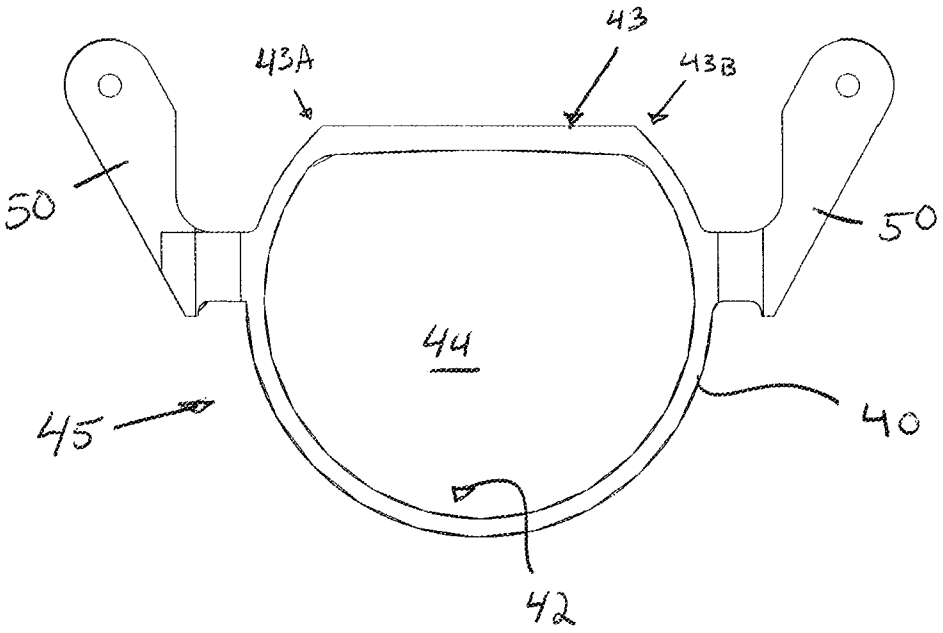
FIG. 3 is a sectional view taken along line 3-3 of FIG. 2.

Turning now to FIGS. 2-3, the example woodwind instrument 20 further includes the body 24, which, as described previously, can be selectively attachable to the head joint 22. In one example, the body 24 is made from an extrusion element 40, such as an aluminum or titanium extrusion with a "D"-shaped cross section 42 (see FIG. 3) that defines a body interior space 44. The use of an extrusion element 40 allows efficient and cost-effective manufacturing, especially when extrusion is used. The use of an aluminum extrusion 40 enables the body 24 of the woodwind instrument 20 and the traditional attachment structures to be one monolithic piece. This feature eliminates the need for chimneys and/or costly and time consuming attachment processes such as welding, silver soldering, and/or brazing used for silver and/or brass musical instruments. Additionally, this feature allows a very strong instrument to be produced with highly custom features.

As shown in FIG. 3, the "D"-shaped cross section 42 of the extrusion 40 provides a substantially flat upper surface 43, and a lower curved surface 45. The substantially flat upper surface 43 has first and second ends 43A, 43B and the lower curved surface 45 connects these first and second ends 43A, 43B of the flat upper surface 43. It is understood that the lower curved surface 45 is intended to include a continuous or non-continuous curved surface, an arching surface, or an effectively curved surface, such as a partial hexagon, octagon, etc. This "D"-shaped cross-section construction offers numerous benefits. For example, the "D"-shaped cross section 42 of the extrusion 40 eliminates the need for continual chimneys extending from the body 24 and also provides a smoother laminar air flow within the body interior space 44. The substantially flat upper surface 43 corresponds to the flat surface of the key pads that seal against the tone holes and provides a more robust seal and a greater sealing surface. The curved lower surface 45 is relatively easy and comfortable for the instrument player to handle. Due to the use of an extrusion, the "D"-shaped cross section 42 is substantially continuous such that the flat upper surface 43 is formed as unitary and monolithic with the curved lower surface 45.

One end of the instrument body 24 can define a body connection hole 46 configured to couple to the head joint connection hole 28. The head joint connection hole 28 and the body connection hole 46 are aligned, and preferably co-axial, such that air can pass between the head joint interior space 26 and the body interior space 44. As the head joint 22 and the body 24 are attached to one another, the body connection hole 46 and the head joint 22 connection hole can be configured to provide a relatively tight fit so as to limit and/or eliminate leakage. Additional seals may or may not be used.

The extrusion of the "D"-shaped cross section 42 of the body 24 can also include wings extending substantially away from the body 24. The wings are part of the original extrusion, and are generally continuous along the length of the body 24. Portions of the wings can then be accurately machined away in order to selectively leave bosses 50 disposed along the length of the body 24, as shown in FIGS. 2-3, such that the bosses 50 are integrally formed with the body 24. In one example, a majority of the wings can be machined away to create bosses 50 that correspond to the posts in traditional woodwind instruments 20. The original wings are typically greater in size and shape than the resulting bosses that have been machined from the wings. It is noted that the bosses 50 may have various shapes; for example, some may extend upwards, or outwards, or at a different angle relatively to other bosses, based upon the intended purpose of each boss. Some of the bosses may provide a rotational axis for a key, while other bosses may provide a mount point for other static elements. This technique of creating the bosses 50 in a monolithic fashion and using them as posts eliminates the need for additional costly welding, silver soldering, and/or brazing of silver and/or brass components to attach posts to the body 24. Additionally, this technique provides a very strong structure that also allows for great customization.

In one example, the machining operation is carried out with a CNC process, or similarly computer-aided manufacturing process, enables relatively fast machining times and relatively accurate machined surfaces. The CNC machining process can also be used to create or drill a plurality of tone holes 52 within the body 24. The tone holes 52 enable air to pass between the body interior space 44 and the space exterior to the woodwind instrument 20. The tone holes 52 can be covered and uncovered by the user to selectively increase and decrease the length of a vibrating column of air within the body interior space 44 to produce the desired musical notes. After the machining operation, the body 24 can be provided with an anodized layer on its exterior. The anodized layer can limit and/or eliminate corrosion on the body 24 portion of the woodwind instrument 20, increase the instrument's durability, and/or impart a desired color scheme to the instrument.

Due to the use of a "D"-shaped cross-section 42 of the instrument body 24, the tone holes 52 can extend completely through the substantially flat upper surface 43 to provide fluid communication between the body interior space 44 and the external environment. The use of CNC machining to bore the holes 52 into the flat upper surface 43 eliminates the need for conventional chimneys, which are typically formed from a stamping or other metal deformation process that results in weak parts that may be damaged and result in an impaired or leaking seal. Moreover, conventional chimneys extend a distance upwards from the nominal upper surface. By contrast, the upper extent of the tone holes 52 is co-extensive with the substantially flat upper surface 43, which provides the added benefit of a more accurate, consistent, and larger sealing surface for the instrument key pads.

Figure 4:
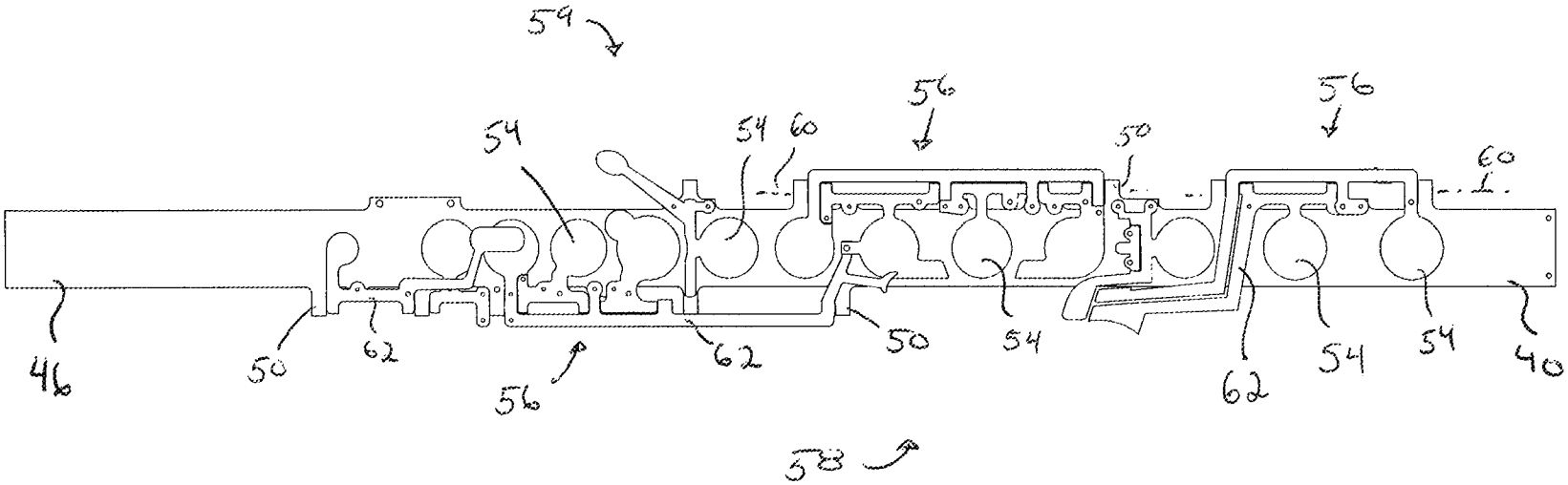
FIG. 4 is a detail top view of the body of the musical instrument.

Turning to FIG. 4, the example woodwind instrument 20 also includes a plurality of keys 54 attached to the body 24. Each key 54 is configured to selectively seal at least one of the plurality of tone holes 52 such that air flow is limited and/or eliminated between the body interior space 44 and the space exterior to the woodwind instrument 20. In one example, the keys 54 are constructed of a relatively strong metal, such as titanium or the like, and can be cut with water jets, CNC, or other computer-aided manufacturing method with possible further finishing operations after the cutting operation. The use of titanium keys enables the woodwind instrument 20 to eliminate relatively heavy steel axles previously used with woodwind instruments 20 having sterling silver and/or brass keys. Titanium keys are relatively rigid, thereby eliminating the need for the structural strength of the relatively heavy steel axles. The use of titanium for the keys and vaulted bridges enables a relatively light and strong single-piece material to replace heavier, multiple-piece silver and/or brass keys and vaulted bridges. As such, the woodwind instrument 20 does not have to sacrifice strength of the keys for weight considerations. While larger woodwind instruments 20 can more easily take on additional weight to ensure strong keys and vaulted bridges, smaller woodwind instruments 20 such as flutes must limit added weight. In other words, the titanium keys and vaulted bridges are lightweight yet still maintain strength and durability. The instrument player may actuate each key by pressing upon the portion of the key directly over the associated tone hole, or alternatively some keys may include an extended key arm or even a vaulted bridge.

Moreover, the titanium keys can be constructed out of a single piece of material. This further eliminates the costly and complicated silver soldering operations used to construct multi-part keys in conventional woodwind instruments 20. Another benefit of the single-piece titanium key is the greater tendency to stay in alignment, thus eliminating a number of costly re-adjustments during the lifespan of the woodwind instrument 20. As shown in FIG. 4, the woodwind instrument 20 can include a system of nesting the keys with exposed axles 56. The axles 56 are typically supported in a rotational manner by one or more bosses 50. This system allows for an instrument that is much more moisture-resistant, durable and easy to adjust for tonal quality.

The conventional, modern woodwind instrument 20 player is handicapped because all the keys typically pivot on the same side of the instrument. Unfortunately, the right hand, which is typically the most active and expressive hand, is forced to operate the keys from the disadvantaged side. The system of nesting the keys with exposed axles 56 enables the woodwind instrument 20 to include vaulted bridges while still maintaining a reliable instrument. Previously, weak materials and design challenges ruled out the possibility of producing a woodwind instrument 20 with this feature. Strong metal keys, such as titanium keys, enable the woodwind instrument 20 to overcome this design challenge. As such, the woodwind instrument 20 can also include a number of the plurality of keys configured to be operable from a first side 58 of the body 24 and the remainder of the plurality of keys 54 are configured to be operable from a second side 59 of the body 24 opposite the first side 58.

The woodwind instrument 20 may further include one or more axles 60 connected by a bridge 62 that can provide the player flexibility to operate certain keys with either hand. The bosses 50 are configured to at least partially confine the axles 60 as shown in FIG. 4. In effect, the bosses 50 can be considered axle posts, or mounts. Each axle 60 may be supported by a single boss, or even by multiple bosses. Additionally, a key may rotate upon a fixed axle, or alternatively a key may be fixed to an axle that is rotatable relative to a supporting boss. Each of the keys can be rotatably mounted to the bosses 50 of the body 24 using the axles 60. The axles 60 can be located on both sides of the flute body 24.

Figure 5A:
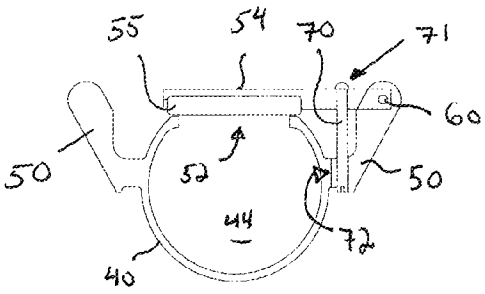
FIGS. 5A-5C are sectional views illustrating an example repair of a key pad.
Figure 5B:
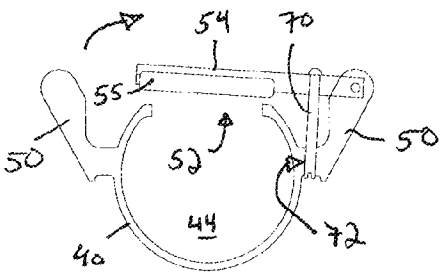
Figure 5C:
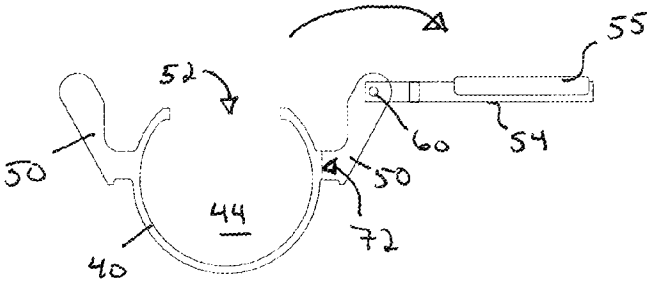

Turning now to FIGS. 5A-5C, the woodwind instrument 20 can further be configured to facilitate maintenance and/or adjustment of the each key 54 and its associated key pad 55. As is common, each key pad 55 can be made from a deformable material, and is periodically removed and replaced from its associated key 54 due to wear. Thus, each key pad 55 is removable from the key 54, and upon re-installation each key pad 55 is then selectively and individually adjusted to provide the desired seal over the tone hole. The woodwind instrument 20 can include a selectively removable key restraint 70 mounted to each key of the plurality of keys 54. As shown in FIG. 5A, the key restraint 70 can be a post or a screw placed within the key 54 to limit the amount of rotation of the key away from its respective tone hole 52. The key restraint 70 and contacting portion 72 of the body 24 can be designed based upon whether a key is normally open or normally closed. As the key is rotated towards or away from the body of the woodwind instrument 20, the key restraint 70 contacts a portion 72 of the body 24 to provide a physical interference, thereby preventing further rotation. As shown in FIG. 5B, a flat spot on the body (as shown), or the curved surface 45 of the body 24, or even an internal or external part of a boss 50 can provide the contact portion 72 to inhibit further rotation of the key 54. However, an upper portion 71 of the key restraint 70 could abut an upper contact portion, such as part of a bridge 62 or other superjacent element. In one example, the body 24 of the woodwind instrument 20 can include a bar or other device to provide a striking surface on the body 24 for the key restraints 70 to contact. Furthermore, the key restraints 70 can include a relatively soft material, such as a pad, on its striking end to limit and/or eliminate any noise and/or scratches as the key restraint 70 contacts the body 24. Additionally, the key restraint 70 can be selectively adjustment, such as provided as a threaded screw or the like, which can enable the instrument player to selectively adjust the rotation amount of each individual key 54 to enable a high degree of customization.

Finally, as shown in FIG. 5C, the key restraint 70 can be selectively removable to enable at least one of the plurality of keys 54 to be lifted away from the body 24 without removing the key from its axle 60. Conventionally, the task of re-padding (i.e., replacing, repairing, or adjusting the key pad 55) any particular key required that multiple keys be opened together and repaired at the same time. This presents numerous problems, such as requiring more than one key to be worked on at a time and further requires the continual re-adjustment of each key in an iterative fashion after other adjacent keys have been adjusted, because conventional keys are inter-related such that adjusting one key alters the properties of each adjacent key. Advantageously, each key 54 in the instant design can be individually rotated and lifted away from the body 24 without disturbing other keys, especially adjacent keys. Preferably, each key 54 can present each access to the key pad 55 by a rotation about the axle 60 by of at least 45 degrees, more preferably at least 90 degrees, and most preferably at least 180 degrees. A stop may be provided to limit outward rotation of the key 54. This enables a woodwind instrument 20 repair person to more quickly and easily re-pad 55 the key 54 without entirely removing the key 54, and also without having to re-adjust each key 54 in an iterative fashion after it and other adjacent keys are re-padded to obtain an optimal fit around the tone hole 52.

Figure 6:
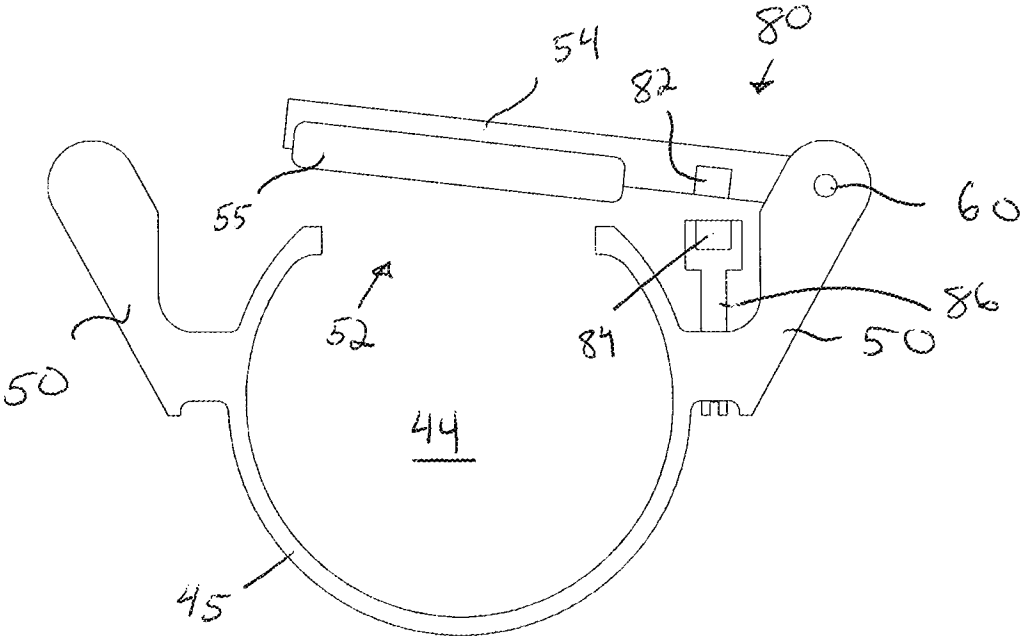
FIG. 6 is a sectional view illustrating one example magnetic key system.

Turning to FIG. 6, the woodwind instrument 20 can further include biasing members 80. In one example, the biasing members 80 can be springs. In another example, the biasing members 80 can include magnets acting as springs. In yet another example, the biasing members 80 can include a combination of springs and magnets. At least one biasing member 80 urges at least one of the plurality of keys 54 to a desired position. The design of various woodwind instruments 20 can include some keys designed to be normally open (i.e., the key pad 55 is separated from the tone hole 52 to enable fluid communication between the body interior space 44 and the space exterior to the woodwind instrument 20 via the tone hole 52). In the example shown in FIG. 6, the biasing member 80 can urge the key to the normally open position when the key is not being operated by the woodwind instrument 20 player. Conversely, some keys are designed to be normally closed (i.e., the key pad 55 seals the tone hole 52 in the body 24 to prevent fluid communication between the body interior space 44 and the space exterior to the woodwind instrument 20). In this case, the biasing member 80 can urge the key to the closed position when the key is not being operated by the woodwind instrument 20 player.

In the instant design, the biasing members 80 for the various keys 54 are preferably magnets that effectively act as springs. The use of magnets provide many benefits, such as a no-contact system for reduced wear, and adjustability of the effective "spring" force provided by the interaction of the magnets. In a normally open key, the pair of magnets are oriented in a repulsing arrangement; in a normally closed key, the pair of magnets are oriented in an attracting arrangement. Regardless of the normally open or normally closed condition of the keys, the biasing members 80 can be configured to increase a closing force on at least one of the plurality of keys 54 as at least one of the plurality of keys 54 is moved to a closed position. The biasing member for a particular key 54 may include one pair of magnets 82, 84. FIG. 6 shows an elevation view of one such pair of magnets 82, 84 that are oriented in a repulsing arrangement to thereby make the key 54 normally open. As the key 54 rotates around the axle 60 to close the tone hole 52, the magnets 82, 84 are configured to push against one another. The instrument player can press downward upon the key 54 to overcome the magnetic force between the magnets 82, 84 to seal the pad 55 against the tone hole 52. When the player releases the key 54 the repulsing magnetic force will push the key 54 back to its normally open position. The magnetic force between a pair of magnets increases exponentially as a function of distance; the closer two magnets are, the stronger the repulsing or attracting force. Thus, a closure force (or opening force) on the key 54 is increased as the key 54 moves closer to the tone hole 52 (and the magnets 82, 84 are physically brought closer together). Thus, the key is quickly and forcefully opened or closed relative to the tone hole 52.

As noted above, the use of magnets provides the benefit of adjusting the effective "spring" force provided by the interaction of the magnets. In one example, a first magnet 82 within a pair of magnets can be located in the key 54. A second magnet 84 can be movably attached to a boss 50 of the body 24. In the particular example shown, the second magnet 84 can be attached to an adjusting screw 86 that is movable relative to the boss 50. As adjustments to the push or pull force between the magnets are desired, the instrument player or woodwind instrument repair person is able to simply rotate the screw 86 to selectively adjust the distance between the magnets 82, 84 by moving the second magnet 84 closer or farther away from the first magnet 82 and thereby increase or decrease the push or pull force of the magnets. Other linear adjustment mechanisms are contemplated (e.g., a sliding shaft with a set screw, keyed structure, cammed structure, etc.). In this way, the key response and closing force can be easily adjusted to suit the individual player's needs and/or adjust the seal over the tone hole.

Figure 7:
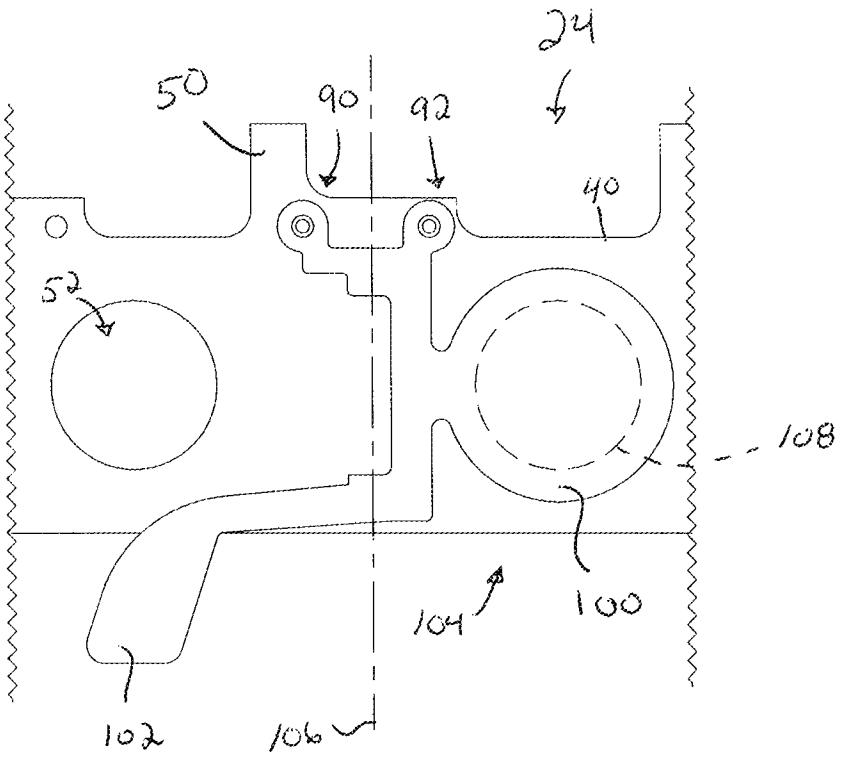
FIG. 7 is a detail top view illustrating another example magnetic key system that is normally closed.

In one example of a flute, a majority of the keys are normally open, although a few of the keys (such as two in the instant design) are normally closed. Turning now to FIG. 7, the biasing member for a particular key may alternatively comprise two sets 90, 92 of a pair of magnets (four total magnets). In the top detail view, only some of the magnets are visible with the remaining two magnets being directly beneath the visible magnets. For discussion purposes, this key is considered a normally closed key 100. As the distal end 102 of the key is operated, the proximal end 104 of the key rotates around the shown axis 106 and separates from the tone hole 108 to remove the seal and open the tone hole 108. As the player desires to close the key again, the player removes a force from the distal end 102 of the key. The magnet pair 90 shown on the left of the rotational axis 106 is configured in a repelling arrangement (i.e., a force extending out of the page). As such, these magnets push the key 100 to a desired position (e.g., the closed position). Additionally, the magnet pair 92 shown on the right of the rotational axis 106 is configured in an attracting arrangement (i.e., a force extending into the page). As such, this second pair of magnets 92 also pulls the key to the desired position (e.g., the closed position) with an increased closure force as the key closes. It is understood that the magnet pairs of the above example could be reversed for a normally open key.

The use of two sets 90, 92 of a pair of magnets can provide numerous advantages. Because the magnetic force varies as a function of distance, the use of two magnet pairs on opposite sides of the key's rotational axis allows a more consistent "spring" feel over the entire rotational travel of the key. For example, when the key 100 is opened the pair of magnets 92 are separated and the magnetic force between them decreases. However, at the same time the other pair of magnets 90 are moved closer together and the magnetic force between them increases. Additionally, although not shown, it is understood that either or both of the two sets 90, 92 of a pair of magnets can be adjustable similar to the example shown in FIG. 6. Because each set of magnets 90, 92 can be individually adjustable, a very high degree of closing (or opening) force customization can be achieved by the instrument player. For example, the player can adjust each magnet pair 90, 92 to achieve a desired balance therebetween.

Figure 8A:
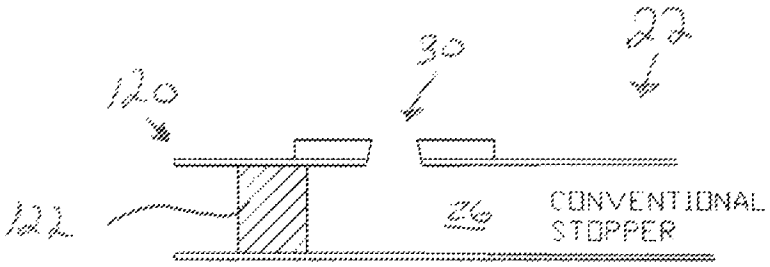
FIGS. 8A-8C are sectional detail views of an example stoppers with optional diaphragms for use with the wind instrument.
Figure 8B:
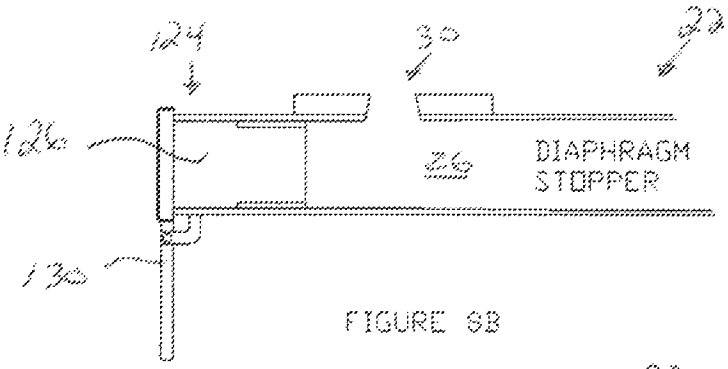
Figure 8C:
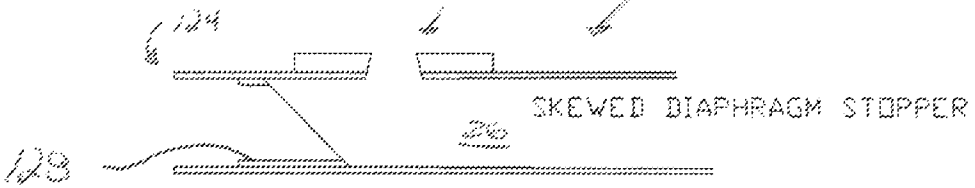

Turning to FIGS. 8A-8C, the instant design can also provide various other benefits. Some woodwind instruments 20, such as flutes, include a head joint 22 with a closed end 120 opposite the head joint 22 connection hole. The closed end can be permanently closed or simply supplied with a stopper 122, such as one of cork material. See FIG. 8A. Other woodwind instruments 20 can include an open end 124. These variations affect the sound of the woodwind instrument 20. The woodwind instrument 20 can also include a diaphragm 126, 128 (see FIGS. 8B-8C) located within the head joint interior space 26. The diaphragm makes the flute much louder and gives it a sound more like a reed instrument. It is useful for playing expressive jazz as well as certain modern music. FIG. 8B shows a straight version of the diaphragm 126, and FIG. 8C shows a skewed version of the diaphragm 128. The angle of the skewed version makes the diaphragm 128 relatively bigger and better for smaller bore instruments. The diaphragm 126, 128 can be constructed of mylar or a metal material placed within the head joint interior space 26. The diaphragm 126, 128 enables the woodwind instrument 20 to produce a sound imitating a traditional reed instrument. Should the player decide to deactivate the diaphragm-created effect, the player can inhibit the vibration of the diaphragm. Inhibiting the vibration of the diaphragm can include placing an object in contact with the diaphragm, or by manually "touching" the diaphragm. In FIG. 8B, a disabling key 130 is shown that the player can hit with their shoulder or other body part. The diaphragm may also be disabled by compressing air in the back chamber using a foot bulb or the like.

An example method of forming a flute will now be discussed. The method includes the steps of forming a head joint 22 using a 3-D printing process, and then encasing the head joint 22 in a strong encapsulating layer, such as a carbon fiber layer. The method then provides a metallic extruded body 24 defining a body interior space 44, where the body includes at least one wing. The method further includes the step of machining the body 24 to create tone holes 52 and removing portions of the wings to form bosses 50 in the vicinity of the tone holes 52. The method further includes the step of mounting at least one axle 60 to the at least one boss, attaching a plurality of keys 54 to the body 24 via the axles 60, and finally attaching the body 24 to the head joint 22. Other method steps are contemplated to provide any or all of the features described herein.

It is to be appreciated that the present disclosure provides a relatively inexpensive woodwind instrument 20 that is strong, lightweight, and durable. Additionally, the woodwind instrument 20, particularly the head joint 22, bosses 50, and keys 54 can be constructed in many different shapes that cannot be produced via other methods of production. The described woodwind instrument 20 enables a relatively inexpensive flute to be manufactured while producing a reliable tone in combination with durability and strength. Previously, keys of woodwind instruments 20 were attached to the body 24 by silver or brass posts which were individually attached to the body 24. However, the woodwind instrument 20 according to the present disclosure includes bosses 50 (akin to traditional posts) and a body 24 that are extruded from a single piece of material. This can create a flute or other woodwind instrument 20 that is accurate in tone, durable, and lightweight.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A wind instrument comprising:

a body, wherein the body comprises one monolithic piece of a metal extrusion having a "D"-shaped cross-section that provides a substantially flat upper surface extending between first and second ends, and a lower curved surface connecting the first and second ends of the flat upper surface, wherein the body defines a body interior space, a body connection hole, and a plurality of tone holes arranged along a longitudinal length of the body and extending through the substantially flat upper surface of the "D"-shaped cross-section to provide fluid communication between the body interior space and an external environment;

a plurality of keys attached to the body, each key of the plurality of keys further including a key pad that is configured to selectively seal at least one of the plurality of tone holes to produce notes of different pitch.

2. The wind instrument of claim 1, further comprising a head joint, wherein the head joint defines a head joint interior space, a head joint connection hole, and a mouth hole, the mouth hole enabling air to pass between a space exterior to the head joint and the head joint interior space, wherein the head joint is selectively attachable to the body with the head joint connection hole and the body connection hole being aligned such that air may pass between the head joint interior space and the body interior space.

3. The wind instrument of claim 1, wherein the body further comprises a plurality of bosses, wherein the bosses and the body are formed as one monolithic piece.

4. The wind instrument according to claim 3, wherein the bosses are formed as a monolithic piece with the lower curved surface of the "D"-shaped cross section.

5. The wind instrument according to claim 3, wherein the wind instrument further includes axles, and the bosses are configured to at least partially confine the axles.

6. The wind instrument according to claim 5, further including a selectively removable key restraint mounted to at least one of the plurality of keys, wherein at least one of the plurality of keys is mounted to one of the axles, the key restraint being selectively removable to enable at least one of the plurality of keys to be pivoted away from the body without removing the at least one of the plurality of keys from the axles.

7. The wind instrument according to claim 5, wherein the axles are exposed.

8. The wind instrument according to claim 1, wherein the body comprises an aluminum extrusion element.

9. The wind instrument according to claim 1, wherein the body further includes an anodized layer to reduce and/or eliminate corrosion.

10. The wind instrument according to claim 1, wherein a number of keys of the plurality of keys are configured to be operable from a first side of the body and a remainder of the plurality of keys are configured to be operable from another side of the body opposite the first side.

11. The wind instrument according to claim 2, wherein the head joint is at least partially formed using a three-dimensional (3-D) printing process and is then encased in carbon fiber material.

12. A wind instrument comprising:

a body defining a body interior space and a plurality of tone holes to provide fluid communication between the body interior space and an external environment;

a plurality of bosses coupled to the body;

a plurality of keys attached to the body via the bosses, each key of the plurality of keys further including a key pad that is configured to selectively seal at least one of the plurality of tone holes to produce notes of different pitch; and a biasing member comprising a pair of magnets associated with a majority of the keys, each pair of magnets including a first magnet attached the body and second magnet attached to one of the keys, wherein said pair of magnets urges said one of the keys to a desired position and is configured to increase an opening or closing force on at least one of the plurality of keys as said key is moved, respectively, to an opened or closed position, and wherein a position of at least one of the first and second magnets is selectively adjustable relative to the other of the first and second magnets to thereby adjust a magnetic force between the first and second magnets.

13. The wind instrument according to claim 12, wherein one of the first and second magnets is coupled to an adjusting screw that is movable to adjust a distance between said first and second magnets.

14. The wind instrument according to claim 13, wherein one of said first magnets is attached to the adjusting screw, and said adjusting screw is attached to a boss of the body to be movable relative to said boss.

15. The wind instrument according to claim 12, wherein at least one key pivots relative to an associated tone hole about a rotational axis, the key further comprising a first pair of magnets located on one side of the rotational axis and a second pair of magnets located on the other side of the rotational axis, wherein both pairs of magnets apply force upon said at least one key.

16. The wind instrument according to claim 15, wherein the first pair of magnets is configured in a repelling arrangement, and the second pair of magnets is configured in an attracting arrangement.

17. The wind instrument according to claim 15, wherein one magnet from the first pair of magnets is coupled to and movable with said at least one key, and wherein one magnet from the second pair of magnets is also coupled to and movable with said at least one key.

18. The wind instrument according to claim 12, further comprising a head joint, wherein the head joint defines a head joint interior space, a head joint connection hole, and a mouth hole, the mouth hole enabling air to pass between a space exterior to the head joint and the head joint interior space, wherein the head joint is selectively attachable to the body with the head joint connection hole being aligned with a body connection hole such that air may pass between the head joint interior space and the body interior space.

19. The wind instrument according to claim 12, further comprising a removable key restraint mounted to at least one of the plurality of keys, wherein at least one of the plurality of keys is mounted to at least one exposed axle, the key restraint being selectively removable to enable at least one of the plurality of keys to be independently pivoted away from the body without removing the at least one of the plurality of keys from the exposed axle.

20. The wind instrument according to claim 12, wherein the body comprises one monolithic piece of a metal extrusion having a "D"-shaped cross-section that provides a substantially flat upper surface extending between first and second ends, and a lower curved surface connecting the first and second ends of the flat upper surface.

* * * * *